US005704552A

United States Patent [19]

Turner et al.

[11] Patent Number: 5,704,552

[45] Date of Patent: Jan. 6, 1998

[54] INJECTOR

[75] Inventors: Paul Turner, Barnwood; Dean Hall, Bristol, both of England

[73] Assignee: Lucas Industries public limited company, Solihull, England

[21] Appl. No.: 679,962

[22] Filed: Jul. 15, 1996

[30] Foreign Application Priority Data

Jul. 29, 1995 [GB] United Kingdom ..... 9515604

[51] Int. Cl.[6] ..... F02M 61/20

[52] U.S. Cl. ..... 239/533.2; 239/533.9

[58] Field of Search ..... 239/533.2, 533.3, 239/533.4, 533.5, 533.6, 533.7, 533.9, 533.11, 584

[56] References Cited

U.S. PATENT DOCUMENTS 3,450,352 6/1969 Roosa ..... 239/533.6

4,092,001 5/1978 Hofmann ..... 239/533.6

4,826,086 5/1989 Ogawa et al. ..... 239/533.9 X

*Primary Examiner*—Andres Kashnikow

*Assistant Examiner*—Robin O. Evans

*Attorney, Agent, or Firm*—Trexler, Bushnell, Giangiorgi & Blackstone, Ltd.

[57] ABSTRACT

An injector is described which includes a holder having an inlet, and a passage for supplying fuel from the inlet to a valve needle seating, an adjustable spring abutment plate being located between the inlet and passage. Adjustment of the position of the plate adjusts the compression of a spring arranged to bias a valve needle into engagement with the seating, hence adjusting the fuel pressure necessary to lift the needle from the seating. The plate is provided with an opening whereby the inlet communicates with the passage.

9 Claims, 2 Drawing Sheets

INJECTOR

This invention relates to an injector for a fuel injection system of a diesel internal combustion engine.

One conventional type of injector comprises a generally cylindrical nozzle body having an outlet orifice at an end thereof, the surface of the body surrounding the orifice defining a valve seat. A valve element in the form of a needle is slidable within the body between a position in which a first end thereof engages the valve seat to prevent fuel flow through the orifice, and a position in which the valve element is spaced from the valve seat permitting such fuel flow.

A spring is provided within a nozzle holder to which the nozzle body is secured, the spring being engaged between an adjustable stop and a second end of the valve element in order to bias the valve element into engagement with the valve seat. The adjustable stop is axially adjustable with respect to the holder, for example by means of being in threaded engagement therewith.

The wall of the holder is provided with a passage arranged to carry fuel from an inlet port for connection to a high pressure fuel source, to a location adjacent the valve seat. The port extends generally radially and is provided adjacent the adjustable stop.

The valve element is provided with a surface arranged such that on the application of high pressure fuel to the injector, the fuel pressure acting against the surface is sufficient to move the valve element against the action of the spring away from the valve seat. When the supply of fuel at high pressure ceases, the valve element moves under the action of the spring such that the first end thereof moves into engagement with the valve seat. It will be recognized that by adjusting the position of the stop, the pre-stress of the spring can be adjusted thus adjusting the pressure which must be applied to the injector in order to move the valve element away from the valve seat.

In order to produce injectors of relatively small diameter, the wall thickness of the holder and body are reduced but the wall thickness of the holder in the vicinity of the inlet port may be insufficient to provide a reliable connection. It is an object of the invention to reduce this problem.

According to the present invention there is provided an injector comprising a housing defining a valve seat, a valve element engageable with the valve seat, an abutment adjustable relative to the housing for adjusting the compression of resilient means provided between the abutment and the valve element, the housing including a passage for carrying fuel towards the valve seat and an inlet for connection to a fuel source, the inlet and the passage being separated by the abutment, wherein the abutment includes an element provided with an opening permitting communication between the inlet and the passage.

By providing the inlet in the wall of the housing opposite that provided with the passage, a greater wall thickness is available for use in connecting a fuel supply line to the injector thus permitting the dimensions of the injector to be reduced for fuel of a given pressure.

The element is preferably slidable within the housing, and conveniently takes the form of a plate slidable within slots provided in the housing.

The invention will further be described, by way of example, with reference to the accompanying drawings, in which like reference numerals denote like parts, and in which.

Figure 1:
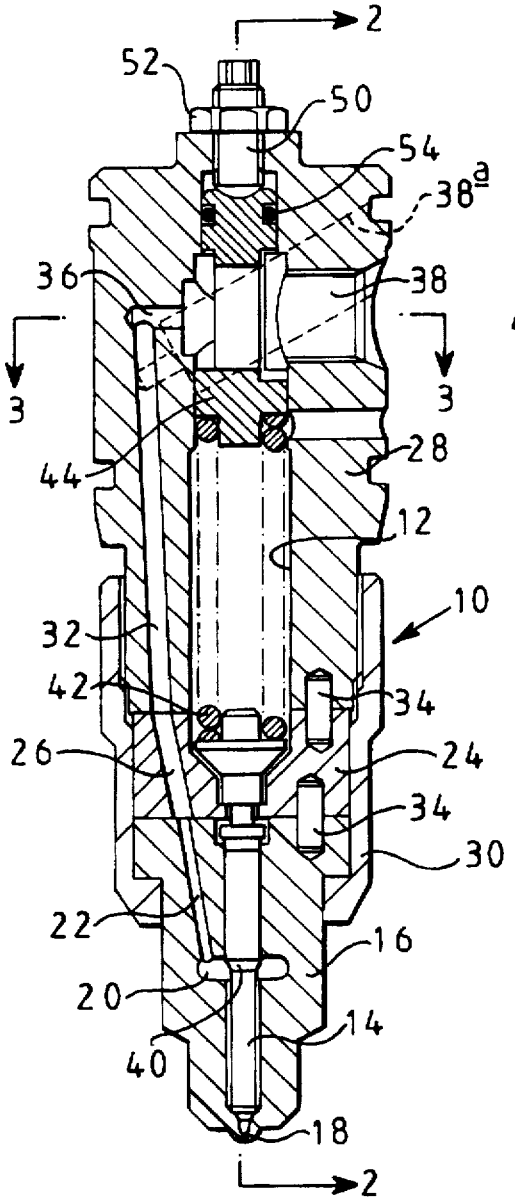
FIG. 1 is a cross-sectional view of an injector in accordance with an embodiment of the invention.
Figure 2:
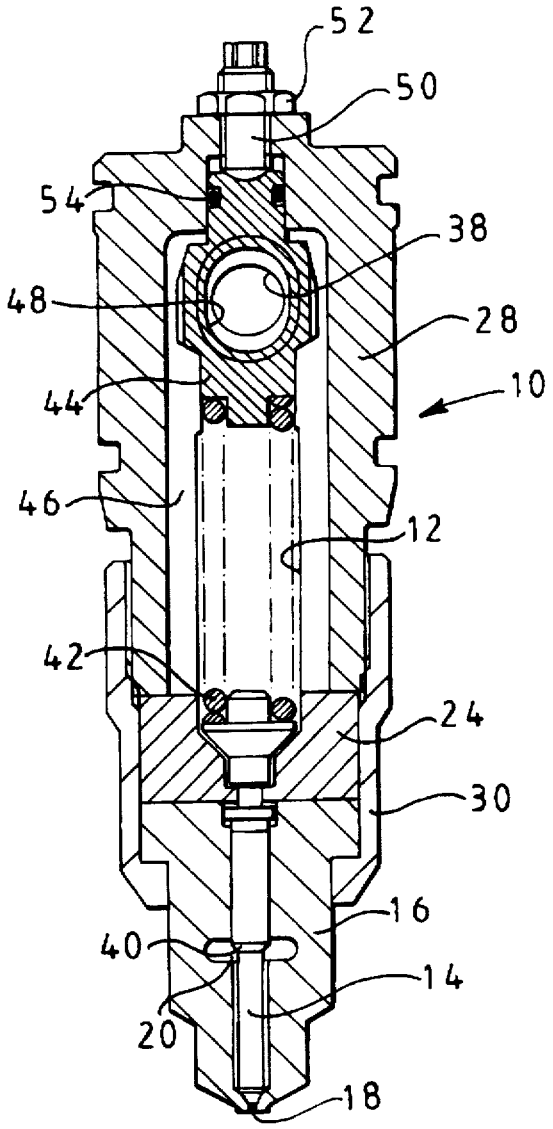
FIG. 2 is a cross-sectional view along the line 2—2 of FIG. 1.
Figure 3:
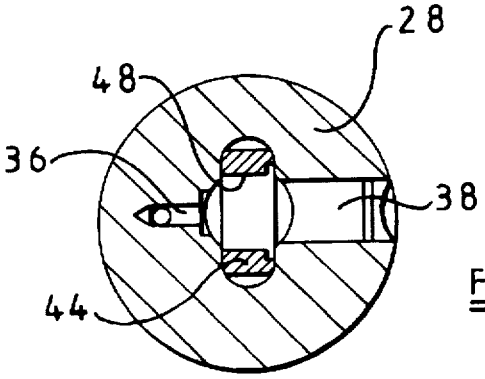
FIG. 3 is a cross-sectional view along the line 3—3 of FIG. 1.

The injector illustrated in FIGS. 1 to 3 comprises a multipart housing 10 having a through passage 12 extending therein, the passage 12 housing a valve needle 14. The housing 10 comprises a nozzle body 16 having an outlet orifice 18, the wall of the body 16 surrounding the orifice 18 forming a valve seat against which an end of the valve needle 14 is engagable to close the orifice 18.

The part of the passage 12 extending through the body 16 is of substantially uniform diameter other than adjacent the valve seat, and approximately half way along this part of the passage 12 where an annular chamber 20 is provided. A passage 22 communicates with the chamber 20.

The housing 10 further comprises a distance piece 24 provided with a passage 26 arranged to communicate with the passage 22, and a nozzle holder 28. The body 16, distance piece 24 and holder 28 are secured to one another by means of a cap 30 in screw-threaded engagement with the holder 28. The holder 28 includes a passage 32 arranged to align with the passage 26, and in order to ensure that the passages 22, 26, 32 align when the housing 10 is assembled, dowels 34 are provided in bores provided in the holder 28, the distance piece 24 and the body 16.

The passage 32 communicates with a radially extending passage 36 which in turn communicates with the passage 12 and with a radially extending inlet including a connector 38 arranged to receive the coupling component 60 (see FIGS. 4 to 7) of a fuel delivery line.

The valve needle 14 is provided with an angled surface 40 arranged to extend within the annular chamber 20, in use. The end of the valve needle 14 remote from the end arranged to engage the valve seat is of substantially greater diameter than the remainder of the valve needle 14 and is arranged to engage an end of a helical spring 42 which is arranged to bias the valve needle 14 towards the position in which the orifice 18 is closed. The other end of the spring 42 engages a plate 44 which is slidable within the passage 12.

As shown in FIG. 2, the portion of the passage 12 within the holder 28 is of non-circular cross-section, unlike the portions extending within the body 16 and distance piece 24. Instead, the portion of the passage 12 within the holder 28 includes a pair of opposed grooves 46 arranged to guide the plate 44 for sliding movement within the holder 28 whilst substantially preventing angular movement thereof.

The plate 44 is provided with an opening 48 arranged to align with the connector 38 to receive an end portion of the coupling component. The opening 48 is of non-circular shape so as to permit limited sliding movement of the plate 44 within the passage 12 whilst the coupling component extends therein.

An adjustable abutment or stop 50 is in screw-threaded engagement with the holder 28, the stop 50 limiting upward movement of the plate 44 under the action of the spring 42. The lock nut 52 is also provided such that once the stop 50 has been set in the desired position, the lock nut 52 can be tightened in order to restrict further movement of the stop 50.

In use, the coupling component of a high pressure fuel supply line is connected to the connector 38 with the end of the coupling component extending through the opening 48 of the plate 44. When fuel is to be delivered by the injector, high pressure fuel is supplied through the supply line to the passage 36 and passages 32, 26 and 22 to the annular chamber 20. The high pressure fuel acts against the angled surface 40 of the valve needle 14 to move the valve needle 14 away from the valve seat against the action of the spring 42. Fuel is then delivered from the orifice 18.

To terminate fuel delivery, the pressure of the fuel within the fuel supply line is permitted to fall to a level which is no longer sufficient to hold the valve needle 14 away from the valve seat and so the valve needle 14 engages the valve seat to close the orifice 18 under the action of the spring 42.

In order to adjust the fuel pressure at which opening of the injector occurs, the level of prestressing of the spring 42 is adjusted. This is achieved by adjusting the position of the stop 50 which in turn adjusts the position of the plate 44 within the passage 12. Once the desired position is reached, the lock nut 52 is tightened in order to avoid further movement.

As shown in FIGS. 1 and 2, an 0-ring seal 54 is provided in order to prevent or reduce the quantity of fuel escaping between the plate 44 and holder 28 towards the stop 50.

Figure 4:
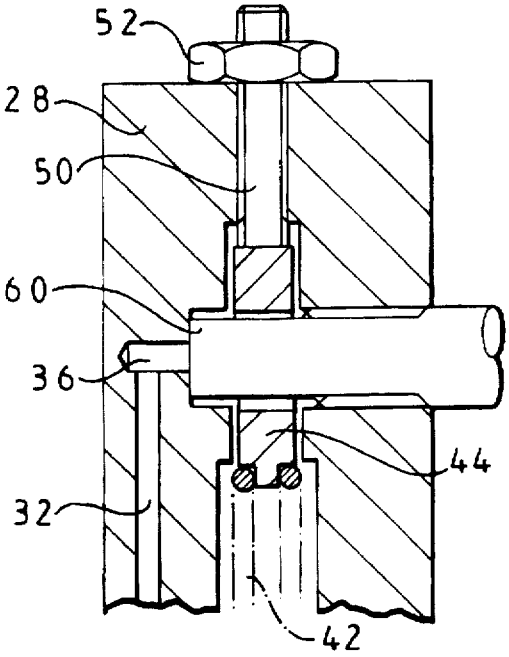
FIG. 4 is a diagrammatic cross-sectional view of part of the embodiment of FIG. 1.
Figure 5:
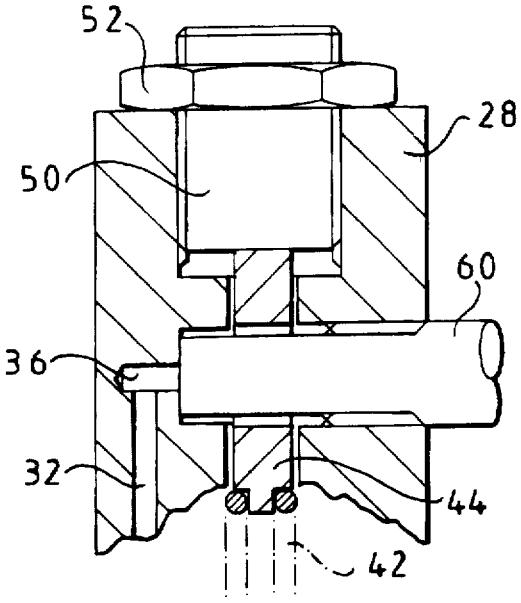
FIGS. 5 and 6 are views similar to FIG. 4 of two alternative embodiments.

FIG. 4 is a diagrammatic cross-sectional view of part of the embodiment of FIG. 1 emphasizing that the plate 44 is of thickness greater than the diameter of the part of the passage 12 within which the stop 50 is received. During assembly of this embodiment, the plate 44 is inserted into the passage 12 before the various components constituting the housing 10 are assembled. The embodiment of FIG. 5 differs in that the part of the passage 12 arranged to receive the stop 50 is of enlarged diameter so as to permit the plate 44 to be introduced after assembly of the housing 10, the plate 44 being introduced from the end of the housing 10 arranged to receive the stop 50 before the stop 50 is positioned.

Figure 6:
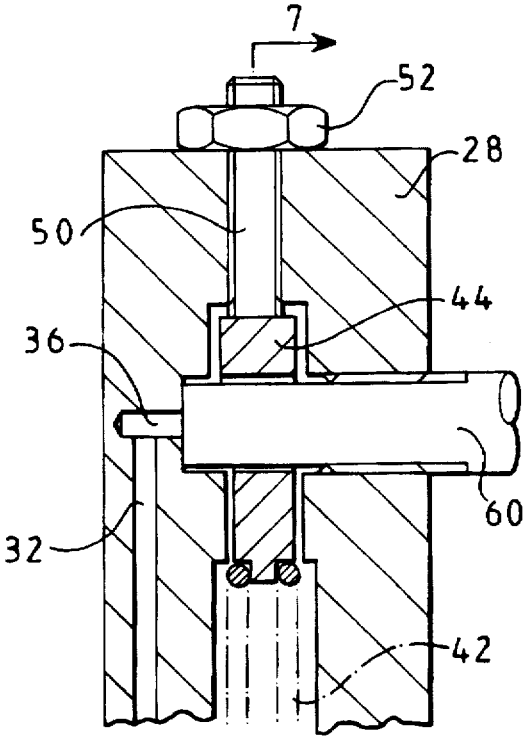
Figure 7:
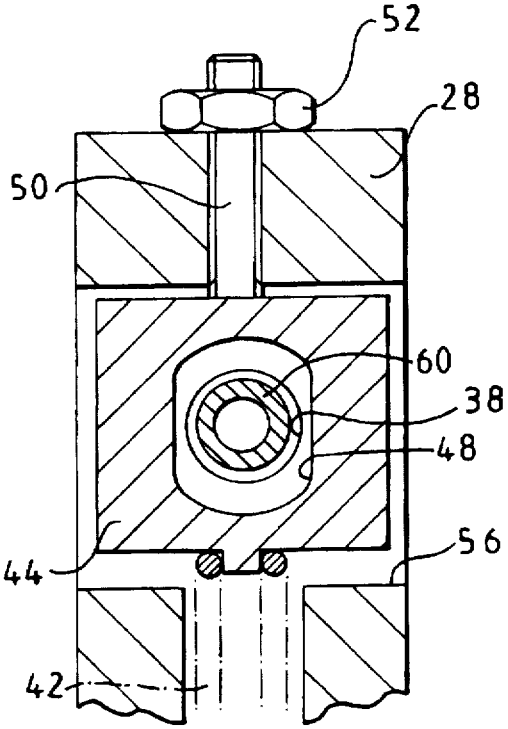
FIG. 7 is a cross-sectional view along the line 7—7 of FIG. 6.

The embodiment illustrated in FIG. 6 and 7 differs from the previously described embodiments in that the holder 28 is provided with a slot 56 arranged to receive the plate 44. The slot 56 is of sufficient length to permit movement of the plate 44 to adjust the stressing of the spring 42, and is oriented so that the coupling component 60 extends through the opening 48 of the plate 44 as in the previously described embodiment. During assembly of this embodiment, the plate 44 is introduced into the injector laterally.

It will be recognized that the plate 44 could be shaped differently to the shapes shown in the drawings, and it is intended that the invention should not be restricted to cover only the illustrated versions. Further, although in the embodiments described hereinbefore the inlet extends radially, perpendicularly to the axis of the passage 12, the inlet may be angled, for example as denoted by the dashed lines 38*a* in FIG. 1, the shape of the opening 48 being changed appropriately, if necessary.

We claim:

1. An injector comprising a housing defining a seating, a valve element engageable with the seating, a resilient member arranged to bias the valve element into engagement with the seating, an abutment adjustable relative to the housing, the resilient member being engaged between the valve element and the abutment whereby adjustment of the position of the abutment with respect to the housing adjusts the compression of the resilient member, a passage provided in the housing for carrying fuel towards the seating, an inlet provided in the housing for connection to a fuel source, the abutment being located between the inlet and the passage, wherein the abutment includes a movable element provided with an opening whereby communication is permitted between the inlet and the passage.

2. An injector as claimed in claim 1, wherein the moveable element comprises a plate slidable within axially extending grooves provided in the housing.

3. An injector as claimed in claim 2, wherein the plate and grooves are dimensioned so as to permit sliding movement of the plate in the axial direction of the housing, but to prevent angular movement of the plate with respect to the housing.

4. An injector as claimed in claim 2, wherein the housing comprises a holder in which the grooves are provided, and a body secured to the holder, the plate being located in the grooves prior to securing the body to the holder.

5. An injector as claimed in claim 2, wherein the housing includes an additional, transverse slot arranged to permit the introduction of the plate into the axially extending grooves.

6. An injector as claimed in claim 2, wherein the housing includes an enlarged opening through which the plate can be introduced, the enlarged opening being arranged to receive an adjusting portion of the abutment.

7. An injector as claimed in claim 3, wherein the housing includes an enlarged opening through which the plate can be introduced, the enlarged opening being arranged to receive an adjusting portion of the abutment.

8. An injector as claimed in claim 1, wherein the opening is non-circular.

9. An injector as claimed in claim 1, wherein the inlet makes an angle other than 90° with the axis of the housing.

* * * * *

UNITED STATES PATENT AND TRADEMARK OFFICE

CERTIFICATE OF CORRECTION

PATENT NO. : B1 5,704,552

DATED : Oct. 5, 1999

INVENTOR(S) : Paul Turner and Dean Hall

It is certified that error appears in the above-identified patent and that said Letters Patent is hereby corrected as shown below:

Column 1, Line 20 "clain" should be -- claim --

Signed and Sealed this

Twenty-first Day of March, 2000

*Attest:*

*Attesting Officer*

Q. TODD DICKINSON

*Commissioner of Patents and Trademarks*

US005704552B1

REEXAMINATION CERTIFICATE (3893rd)

United States Patent [19] [11] B1 5,704,552

Turner et al. [45] Certificate Issued Oct. 5, 1999

[54] INJECTOR

[75] Inventors: Paul Turner, Barnwood; Dean Hall, Bristol, both of United Kingdom

[73] Assignee: Lucas Industries Public Limited Company, Solihull, United Kingdom

Reexamination Request:
No. 90/005,111, Sep. 21, 1998

Reexamination Certificate for:

| | |
|---|---|
| Patent No.: | **5,704,552** |
| Issued: | **Jan. 6, 1998** |
| Appl. No.: | **08/679,962** |
| Filed: | **Jul. 15, 1996** |

[30] Foreign Application Priority Data

Jul. 29, 1995 [GB] United Kingdom ..... 9515604

[51] Int. Cl.[6] ..... F02M 61/20

[52] U.S. Cl. ..... 239/533.2; 239/533.9

[56] References Cited

FOREIGN PATENT DOCUMENTS 2136705 4/1972 France .

*Primary Examiner*—Andres Kashnikow

[57] ABSTRACT

An injector is described which includes a holder having an inlet, and a passage for supplying fuel from the inlet to a valve needle seating, an adjustable spring abutment plate being located between the inlet and passage. Adjustment of the position of the plate adjusts the compression of a spring arranged to bias a valve needle into engagement with the seating, hence adjusting the fuel pressure necessary to lift the needle from the seating. The plate is provided with an opening whereby the inlet communicates with the passage.

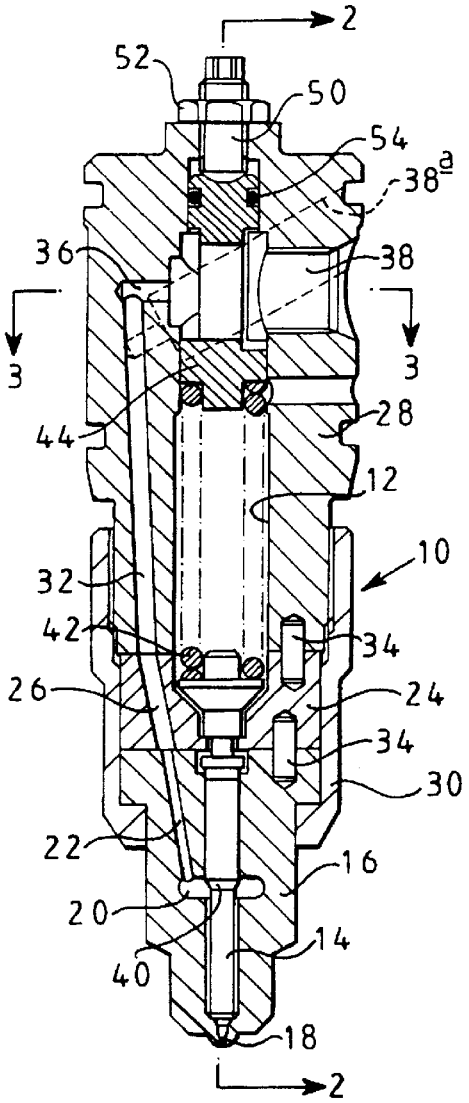

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is cancelled.

Claims 2, 8 and 9 are determined to be patentable as amended.

Claims 3–7, dependent on an amended clain, are determined to be patentable.

2. An injector [as claimed in claim 1] *comprising a housing defining a seating, a valve element engageable with the seating, a resilient member arranged to bias the valve element into engagement with the seating, an abutment adjustable relative to the housing, the resilient member being engaged between the valve element and the abutment whereby adjustment of the position of the abutment with respect to the housing adjusts the compression of the resilient member, a passage provided in the housing for carrying fuel towards the seating, an inlet provided in the housing for connection to a fuel source, the abutment being located between the inlet and the passage, wherein the abutment includes a movable element provided with an opening whereby communication is permitted between the inlet and the passage*, wherein the moveable element comprises a plate slidable within axially extending grooves provided in the housing.

8. An injector as claimed in claim [1] *2*, wherein the opening is non-circular.

9. An injector as claimed in claim [1] *2*, wherein the inlet makes an angle other than 90° with the axis of the housing.

* * * * *